US008479343B2

(12) United States Patent
Smetana

(10) Patent No.: US 8,479,343 B2
(45) Date of Patent: Jul. 9, 2013

(54) ROTATABLE CONTAINER INTERIOR CLEANING MECHANISM

(75) Inventor: Matthew J. Smetana, Sparta, NJ (US)

(73) Assignee: Matthew J. Smetana, Sparta, NJ (US)

( * ) Notice: Subject to any disclaimer, the term of this patent is extended or adjusted under 35 U.S.C. 154(b) by 420 days.

(21) Appl. No.: 12/778,286

(22) Filed: May 12, 2010

(65) Prior Publication Data

US 2011/0277262 A1 Nov. 17, 2011

(51) Int. Cl.
*A46B 13/02* (2006.01)

(52) U.S. Cl.
USPC ..... 15/56; 15/57; 15/59; 15/71; 15/164; 15/104.096

(58) Field of Classification Search
USPC ..... 15/164, 165, 212, 213, 104.068, 15/104.095, 104.096, 101, 56, 59, 65, 71, 15/72
See application file for complete search history.

(56) References Cited

U.S. PATENT DOCUMENTS

| | | | | | |
|---|---|---|---|---|---|
| 180,080 | A | * | 7/1876 | Drezer | 15/97.1 |
| 361,502 | A | * | 4/1887 | Gibson | 15/104.067 |
| 705,983 | A | * | 7/1902 | Volckening | 15/104.9 |
| 856,160 | A | * | 6/1907 | Kerouse | 15/165 |
| 1,539,718 | A | * | 5/1925 | Crum | 15/56 |
| 1,827,569 | A | * | 10/1931 | Edgar | 15/165 |
| 1,875,613 | A | * | 9/1932 | Kahlert et al. | 15/104.066 |
| 2,037,870 | A | * | 4/1936 | Whisler et al. | 15/65 |
| 2,170,740 | A | * | 8/1939 | Volckening | 15/104.9 |
| 2,205,379 | A | * | 6/1940 | Giacomo | 403/120 |
| 2,208,901 | A | * | 7/1940 | Hawkinson | 15/104.067 |
| 2,219,555 | A | * | 10/1940 | Burwell | 15/104.18 |
| 2,420,260 | A | * | 5/1947 | Myszkowski | 15/22.1 |
| 2,432,924 | A | * | 12/1947 | Yuriko et al. | 15/212 |
| 3,487,841 | A | * | 1/1970 | Goodrum | 134/167 R |
| 4,317,249 | A | * | 3/1982 | Benson | 15/213 |
| 4,562,608 | A | * | 1/1986 | Weir | 15/104.067 |
| 4,768,255 | A | * | 9/1988 | Wolfanger | 15/104.068 |
| 5,423,621 | A | * | 6/1995 | Russell | 401/9 |

(Continued)

*Primary Examiner* — Joshua J Michener
*Assistant Examiner* — Alp Akbasli

(57) ABSTRACT

A hand-held, collapsible, self-adjusting mechanism, which is an improvement to the Spatula, for removing the remaining contents inside a plurality of containers. The device consists of three attached arms, two lower arms geared around their pivot ends to each other to keep their rotation symmetrical in relation to a drive arm, and pressurized with a double torsion spring to rotate towards said drive arm to apply pressure to a swiveling attachment receiver at the opposite end which makes contact with the inside walls of a container. The drive arm has a foldable crank arm assembly which allows you to quickly rotate and slide the mechanism in and out within a container with one hand while the other hand supports said container thus removing the contents from the walls of the container without difficulty or a mess.

References Cited

U.S. Patent Documents

| | |
|---|---|
| 2,065,866 A * December 1936 Clift | 15:245 |
| 7,182,377 B2 | 294/7 |
| 5,674,042 B65B 69/00 | 414/420 |
| 6,424,812 B1 | 399/262 |
| 3,934,300 | 15/244 |
| 5,626,683 | 134/8 |
| 5,732,434 | 15/93.1 |
| 5,491,868 | 15/236.09 |
| D262,428 | D7/150 |
| 4,106,193 | 30/172 |
| 2,188,114 | |
| 2,065,886 | |
| 1,228,437, 1,184,606, 1,180,230 | 15/104.18 |
| US 2005/0264017 A1 | |

Foreign Patent Documents

| | | | |
|---|---|---|---|
| SU | 001774860* | November 1992 | 294:7 |
| EP | 0854099 (A1) | B65D88/68 | |

5 Claims, 2 Drawing Sheets

U.S. PATENT DOCUMENTS

| | | | | |
|---|---|---|---|---|
| 6,892,416 | B2 * | 5/2005 | Lee et al. | 15/164 |
| 7,543,348 | B2 * | 6/2009 | Le | 15/65 |
| 8,011,051 | B1 * | 9/2011 | Ba-Akeel et al. | 15/56 |
| 2002/0112301 | A1 * | 8/2002 | Lee et al. | 15/164 |
| 2006/0185104 | A1 * | 8/2006 | Le | 15/22.1 |
| 2006/0260079 | A1 * | 11/2006 | Horton | 15/165 |
| 2007/0119011 | A1 * | 5/2007 | Ho et al. | 15/172 |

* cited by examiner

ROTATABLE CONTAINER INTERIOR CLEANING MECHANISM

BACKGROUND OF THE INVENTION

1. Field of the Invention

The present invention is related to scrapers and spatulas which are used to obtain the contents which have clung to the inner walls and floor or ceiling of a plurality of container including pipes.

2. Description of Related Art

In the prior art most spatulas are made of various shaped scraper ends with various shaped handles. The spatula end is semi flexible, yet rigid enough to detach the contents of the container without permanently deforming the spatula. Previous designs were very laborious requiring the spatula to be repeatedly maneuvered within the container while manually rotating the container attempting to bring it's contents to the top and out. They also had difficulty conforming to the many shapes of containers and would require multiple sizes for multiple shaped containers. Additionally they are typically too large to be effective to fit into a container with a wide base and narrow neck. They also had difficulty removing the contents that might collect at the angled part just below the neck of the container.

Other prior art includes a motorized, container spinning machine. This type required an intricate motorized device to rotate the container with a stationary semi rigid scraper. These devices would only work for round semi smooth containers of consistent shape. These devices are expensive, are required to be plugged in, are very cumbersome, and primarily immobile.

Still other prior art includes mechanisms for cleaning a multitude of sizes of pipes. This prior art is limited in it's ability to make lineal contact with the walls of a container. It has far more surface area to it, making it's cleanup more difficult. It is too wide to fit within a narrow necked container, and it is also not capable of folding down to a compact size for storage.

The object of this invention is to provide a compact, portable device that will effectively remove the majority of the contents inside of a wide range of size and shape containers quickly and with minimal mess.

SUMMARY OF THE INVENTION

The present invention consists of:

Two lower arms (all references to lower and upper are made in relation to how the mechanism is oriented in FIG. 1) each with gear-like teeth notched into their upper end concentric to a hole, and at the lower end of said arms a 2nd hole.

The side by side pins of the Shield With Double threaded standoff assembly slide thru the gear end holes of said lower arms and thru the two adjacent, equally spaced holes in the drive arm's lower end so that the widest section of the pin on said Shield With Double threaded standoff is contiguous with the "lower arm" face of the drive arm (note: all references to "pins" describe a shaft that penetrates thru a hole(s) attaching two or more parts, but allowing motion for 1 or more of those parts in relation to the other(s), while keeping the assembly together).

The pins of the Shield With Double threaded standoff and the holes of the drive arm are positioned so that the gear-like teeth of the lower arms engage with one another, and the arms are free to rotate around the pins. The engaged gears of the lower arms force both arms to rotate symmetrically in relation to the drive arm.

A continuous double torsion spring is also slid over the projection of the pins of the Shield With Double threaded standoff, which extends out past the drive arm holes thru the spirals of the spring. Said projection is then covered by the spacers of the Shield w/ double standoff spacer which become contiguous with the spring face of the drive arm. The spacer is long enough to allow the spring to move freely when the lower arms rotate.

Nuts are then threaded over the threads of the Shield With Double threaded standoff, locking the assembly tight together while allowing the lower arms and the ends of the double torsion springs to swing around the pins of said Shield With Double threaded standoff and the spacer of the Shield With Double spacer.

The two ends of the double torsion spring that are curved in a u-shape, hook around the shaft of the lower arms such that rotating the arms away from the drive arm tightens the spring coils. Both coils of the double torsion spring are spiraled opposite to each other such that the further the lower arms are rotated away from the drive arm the more resistance the spring applies to the rotation. By the double torsion spring being continuous the connecting portion of said double torsion spring resists the rotational tendency of each half of the double torsion spring when tension is applied.

Penetrating thru the hole in the bottom end of the lower arms is another pin which links one end of a swiveling attachment receiver to said lower arms. The pin allows said swiveling attachment receiver to swing away from the lower arms.

At the top of the swiveling attachment receiver is an optional small spring which also attaches to the lower half of the lower arm keeping said swiveling attachment receiver from swinging more than 90 degrees away from said lower arm, and providing pressure to separate the swiveling attachment receiver from the lower arm the closer to parallel the two parts get.

The swiveling attachment receiver has two sweeping edges designed to dislodge any food or material that is stuck to a containers interior when slid across said container's surface. The double edge allows said swiveling attachment receiver to be slid in two opposing directions while still accomplishing the same results. The face of the surface of the swiveling attachment receiver closest to the container is curved away from the container to maximize the contact of the sweeping edges of said swiveling attachment receiver.

The bottom tip of the swiveling attachment receiver has an adjustable looped band that is permanently attached to one of the swiveling attachment receivers. The user then determines which loop measures far enough from the connected end to best match the widest interior width of the container. This loop is then hooked onto the other swiveling attachment receiver.

A crank arm is mechanically attached perpendicular to The Drive arm at it's top end to provide leverage when rotating the mechanism.

The opposite end of the crank arm has a curved plate, referred to as the grip arm receiver, at the top with a hole to attach it to the pivot arm with a pin. The pin attaches the pivot arm to the crank arm allowing the pivot arm to swing away from the crank arm. The rotation is limited to 90 degrees by means of a stop on the curved plate that blocks the arm from further rotation.

A padded grip wraps around the pivot arm in such a way to allow continuous rotation of the grip around the pivot arm. At both ends of the grip on the pivot arm there are bands where it widens to prevent the grip from sliding in either direction while still allowing it to rotate.

Such that by Rotating these spring loaded arms more than 90 degrees away from the drive arm creates pressure from the spring to swing the arms back against the drive arm. This pressure when placed inside of a container keeps the spatula-like heads at the ends of the spring loaded arms in continuous contact with the inside walls of the container, to better clean the undulating surfaces of various shaped containers. The gearing of the two lower arms to each other keeps them symmetrical to the drive arm, which keeps the assembly centered to the container, which it is cleaning. This centering helps the crank arm to operate in a smooth rotation with only 1 hand on the mechanism. The padded grip is allowed to rotate around the pivot arm to allow the cranking hand to stay engaged with the mechanism while cranking for better control. This continuous rotation allows the user to quickly dislodge most of the containers contents far quicker and with better maneuverability than the prior art. The fold-down pivot arm, and the range of rotation of the lower arms into the closed position allow the mechanism to take up a minimal amount of space when being stored.

BRIEF DESCRIPTION OF THE DRAWINGS

FIG. 7*b* Shows optional motorized rotational attachment in lieu of a crank arm.

DETAILED DESCRIPTION OF THE PREFERRED EMBODIMENT

Figure 1:
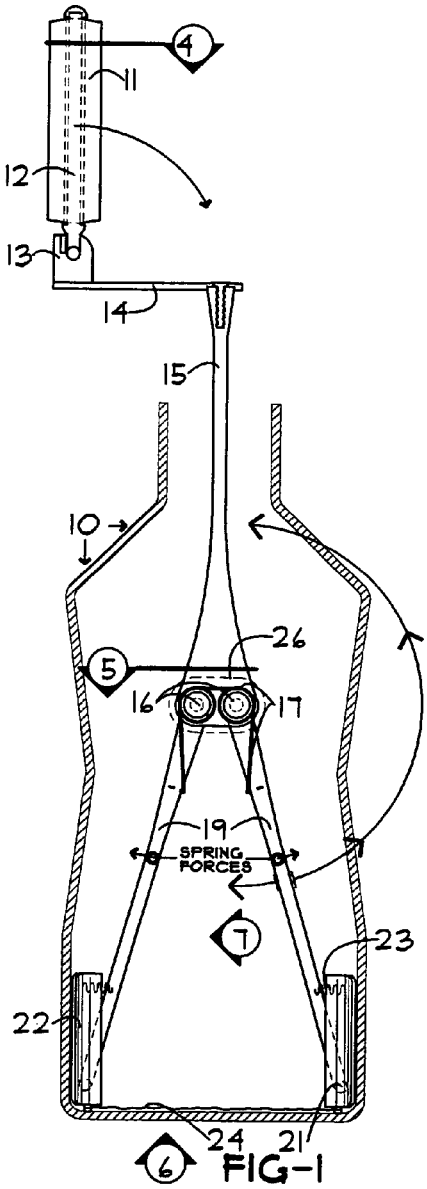
FIG. 1 Shows The Spring Side View Of The Mechanism Inside of a Irregular Container.
Figure 7:
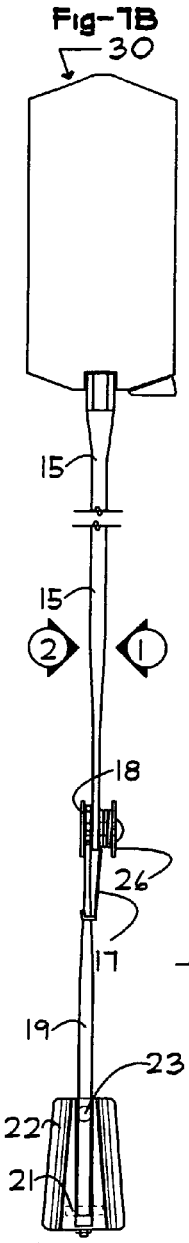
FIG. 7 Shows The Inside Elevation of the swiveling attachment receiver.
Figure 3:
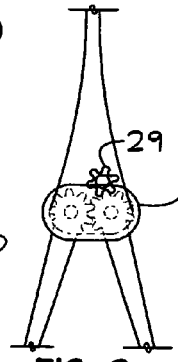
FIG. 3 Shows The Side Elevation of the Shield Over the Gear Ends (same Shield Over Spring Coils).
Figure 2:
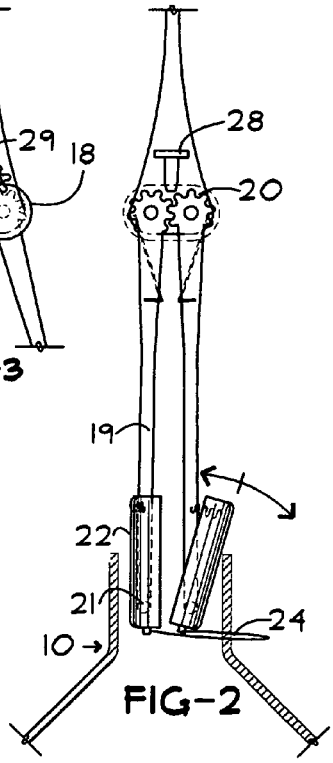
FIG. 2 Shows The Gear Side View of the Lower Arms.
Figure 6:
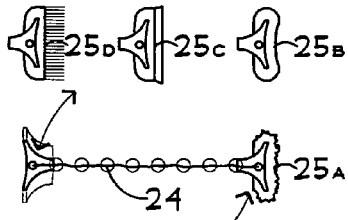
FIG. 6 Shows The Plan View of the swiveling attachment receiver And Looped Band with multiple head options.
Figure 5:
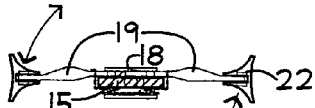
FIG. 5 Shows The Plan/Section Thru the Center Intersection of the 3 Arms.
Figure 4:
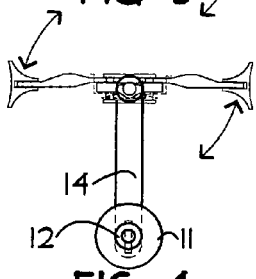
FIG. 4 Shows The Top Plan of the Crank Arm Opened.
Figure 9:
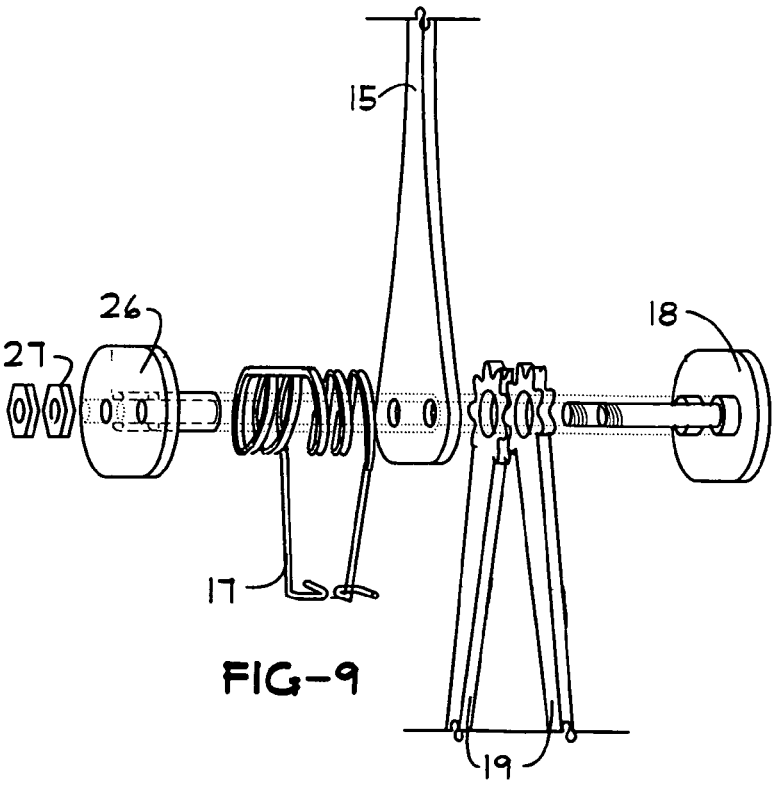
FIG. 9 Shows the partial enlarged exploded isometric view of the central intersection of the Drive arm, the lower arms, the double torsion spring and their connectors.
Figure 8:
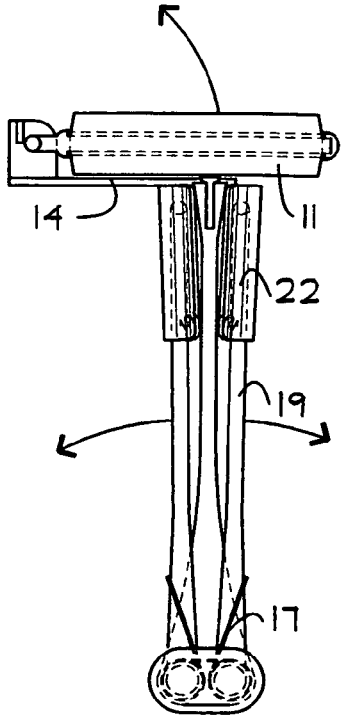
FIG. 8 Shows the Mechanism in the Folded Closed Position.

10. Container To Be Cleaned (oriented With Opening Angled Down When Using Mechanism).

11. Padded Grip, which freely Rotates Around (12) the Grip Pivot Arm.

12. Grip-Pivot Arm which pivots in relation to (14) the crank arm, with stops at either end of (11) the padded grip to prevent the grip from sliding out of position.

13. Grip Arm Receiver, with a stop at 90 degrees, permanently attached to (14) the crank arm, and linking (12) the grip-pivot arm by a pin allowing 90-degree rotation.

14. Crank Arm mechanically or permanently Attached at it's opposite end To The top of (15) the Drive Arm.

15. Drive Arm linking the (14) crank arm to the (19) lower arms.

16. Double Hole In Drive Arm to receive pins for lower arms.

17. Double Torsion Spring Around Sleeves of (26) Shield w/ double standoff spacer, with the ends hooked around (19) the rotating lower arms. Each Half of the double spring applies rotational pressure opposite The Other onto the lower arms to swing them adjacent to the drive arm.

18. Shield With Double threaded standoff to penetrate thru the gear ends of (19) the rotating lower arms attaching them to (15) the drive arm and also thru (17) the double spring coils to lock all of their part together while allowing full rotation of (19) the rotating lower arms.

19. Rotating Lower Arms Spring Loaded by (17) Double Torsion Spring (1 Clockwise, 1 Counterclockwise) Away From Ea. Other when fully rotated, and towards (15) the drive arm, to Apply Pressure To The Insides Of The Container.

20. Geared Ends Of Lower Arms are interlocked to each other To Keep Rotation Symmetrical To Drive Arm.

21. Pivot Pin at base of lower arms to attach to swiveling attachment receiver.

22. Double Sided swiveling attachment receiver, Curved so that when slid across the rigid inside surface of a container they will dislodge the material clinging to the inner surface Of the Container, and tapered to push the contents towards the opening, and out of said container.

23. Optional Spring connecting the swiveling attachment receiver To the Lower Arm To Allow the Surface Of said (22) swiveling attachment receiver To Conform To The Shape Of The Container While Applying Pressure (Alternative methods for achieving the same results including but not limited to torsion springs, elastic band, and adjustment to pivot point)

24. Adjustable Looped Band To Hook On (22) the swiveling attachment receiver To Clean Jar Bottom Surface, and To Keep Lower Arms From Fully retracting to the closed position.

25. Additional Heads Available Which Slide Over (22) the swiveling attachment receiver or are installed in lieu of the said swiveling attachment receiver illustrated, for Multiple Other Uses. Including But Not Limited To:

A. Abrasive material For Scrubbing, sanding, etc.

B. Sponge For Irregular Surface Cleaning, Or for the Spreading of any liquid or gel C. Blade For Scraping D. Brush For Painting or applying a finish

26. Shield w/ double standoff spacer to slide over projections of threaded ends of (18) Shield With Double threaded standoff to allow spring to move freely between shield and (15) the drive arm.

27. Nuts onto screw ends of (18) Shield With Double threaded standoff (optional permanent capping to prevent withdrawal of (18) Shield With Double threaded standoff from assembly)

28. Optional Sliding wedge to engage with gears of the lower arms to prevent rotating

29. Optional Slowing gear to engage with one of the lower arm's gear to prevent both arms from quickly springing back against the drive arm

30. A small battery powered hand held motor assembly in lieu of the crank arm assembly to power the rotation of the remainder of the mechanism.

*The size, shape and proportion of the multiple parts of the mechanism shown are not to limit the scope of the applications of this mechanism, but rather are to clearly illustrate the working relationships between the parts. Multiple Size, strength and shape Arms And remaining other Parts of this mechanism in a similar configuration are covered by this design for the Various Applications which this type of device may be utilized.

I claim:

1. A compact, portable, self adjusting, foldable mechanism which can with one hand be inserted and rotated within an extensive plurality of sized and shaped containers including non-cylindrical containers and those with narrow necks that applies continuous symmetrical pressure to the inside surfaces of said containers allowing the easy extraction of materials within said container for use, comprised of:

two lower arms each mechanically attached by a pinned connection at the top end of each arm to the lower end of a drive arm, while still being able to rotate freely in relationship to said drive arm, and engaged with one another with a geared end such that the two said lower arms rotate symmetrically in relationship to said drive arm, a double torsion spring, installed concentric to the pivot points of said lower arms, and hooked onto the side of said arm which applies symmetrical pressure to rotate the lower ends of said lower arms towards said upper arm, which as said arms are rotated away from said drive arm, results in added resistance to rotation the further you rotate it, which translates into applying pressure to the inside surface of said container within which said lower arms are released onto, swiveling attachment receivers at the opposite end to the hinge of both of said two lower arms, which are connected to said arms with a hinge pin at the far end and a spring at the upper end such that said swiveling attachment receivers swing off of said lower arms so that said swiveling attachment receivers can better align with the angles of said container's walls within which said mechanism is inserted as pressure is applied to said containers interior surfaces, a rotation inducing device attached to the opposite end of said drive arm for the purpose of rotating said lower arms with said swiveling attachment receivers and said drive arm within said container that said assembly is inserted into, an adjustable looped band to hook on the tip of said swiveling attachment receivers to aid in cleaning said containers bottom surface, and to keep said lower arms from fully retracting to a closed position against said drive arm, whereby said mechanism uses the pressure created by said torsion springs applied to said lower arms rotating towards said drive arm to create pressure between said Swiveling attachment receivers and the interior face of the walls of said container within which it is inserted, whereby the gearing of said lower arms keeps said upper arm centered within said container, and said rotation inducing device enables a user to quickly and easily with one hand rotate said mechanism and slide said swiveling attachment receivers along the majority of the interior surfaces of said container.

2. The mechanism as claimed in claim 1 where an additional slowing gear is engaged with one of said lower arms gears to slow the return of said arms to a closed position against said drive arm.

3. The mechanism as claimed in claim 1 where said mechanism is placed between two parallel or close to parallel planes and slid vertically and horizontally so as to remove clinging material off of one or both surfaces.

4. The mechanism as claimed in claim 1 where the double torsion spring is adjustable to change the amount of pressure exerted by said springs to said lower arms.

5. The mechanism as claimed in claim 1 where an additional sliding stop is engaged with both said lower arms gears to stop the return of said lower arms to said closed position.

* * * * *